US010510469B2

(12) United States Patent
Kumada

(10) Patent No.: US 10,510,469 B2
(45) Date of Patent: Dec. 17, 2019

(54) COAXIAL CABLE AND WIRING HARNESS USING SAME

(71) Applicant: YAZAKI CORPORATION, Tokyo (JP)

(72) Inventor: Taketo Kumada, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 236 days.

(21) Appl. No.: 14/881,601

(22) Filed: Oct. 13, 2015

(65) Prior Publication Data

US 2016/0035461 A1 Feb. 4, 2016

Related U.S. Application Data

(63) Continuation of application No. PCT/JP2014/061747, filed on Apr. 25, 2014.

(30) Foreign Application Priority Data

Apr. 26, 2013 (JP) ..... 2013-093856

(51) Int. Cl.
*H01B 7/36* (2006.01)
*H01B 11/18* (2006.01)
*H01B 7/00* (2006.01)

(52) U.S. Cl.
CPC ..... *H01B 11/1834* (2013.01); *H01B 7/0045* (2013.01); *H01B 7/361* (2013.01); *H01B 11/1813* (2013.01)

(58) Field of Classification Search
CPC ..... H01B 7/36; H01B 7/361; H01B 7/365
USPC ..... 174/28, 112
See application file for complete search history.

(56) References Cited

U.S. PATENT DOCUMENTS 3,551,586 A * 12/1970 Dembiak ..... H01B 9/022 156/714
4,987,274 A * 1/1991 Miller ..... H01B 3/445 174/102 R
7,084,343 B1 * 8/2006 Visser ..... C09D 167/00 174/102 R
2009/0114418 A1 * 5/2009 Smith ..... G09F 3/00 174/112

(Continued)

FOREIGN PATENT DOCUMENTS

EP 1630827 A1 3/2006
JP 51-27882 U 2/1976
JP 08-298027 A 11/1996

(Continued)

OTHER PUBLICATIONS

Chinese Office Action for the related Chinese Patent Application No. 201480023699.1 dated May 4, 2016.

(Continued)

*Primary Examiner* — Chau N Nguyen
(74) *Attorney, Agent, or Firm* — Kenealy Vaidya LLP

(57) ABSTRACT

A coaxial cable has an inner conductor, an insulator provided on an outer circumference of the inner conductor, a film provided on an outer circumference of the insulator, an outer conductor provided on an outer circumference of the film, and a sheath provided on an outer circumference of the outer conductor. At least a part of the film is colored in a different color from both colors of the insulator and the outer conductor.

8 Claims, 4 Drawing Sheets

(56) References Cited

U.S. PATENT DOCUMENTS

2011/0011638 A1 1/2011 Gemme et al.

FOREIGN PATENT DOCUMENTS

| | | | |
|---|---|---|---|
| JP | 2004-356021 | A | 12/2004 |
| JP | 2005-166363 | A | 6/2005 |
| JP | 2008-269990 | A | 11/2008 |
| JP | 2012-119231 | A | 6/2012 |
| JP | 2012-138285 | A | 7/2012 |

OTHER PUBLICATIONS

International Preliminary Report on Patentability and English language Written Opinion of the International Search Report for PCT/JP2014/061747.
International Search Report for PCT Patent App. No. PCT/JP2014/061747 (dated Jul. 22, 2014) with English translation thereof.
Chinese Office Action for the related Chinese Patent Application No. 201480023699.1 dated Jan. 5, 2017.
Chinese Office Action for the related Chinese Patent Application No. 201480023699.1 dated Aug. 3, 2017.
Japanese Office Action for the related Japanese Patent Application No. 2014-091624 dated Dec. 19, 2017.
Chinese Office Action for the related Chinese Patent Application No. 201480023699.1 dated Feb. 2, 2018.

* cited by examiner

COAXIAL CABLE AND WIRING HARNESS USING SAME

CROSS REFERENCE TO RELATED APPLICATION

This application is a continuation of PCT application No. PCT/JP2014/061747, which was filed on Apr. 25, 2014 based on Japanese Patent Application (No. 2013-093856) filed on Apr. 26, 2013, the contents of which are incorporated herein by reference. Also, all the references cited herein are incorporated as a whole.

BACKGROUND OF THE INVENTION

1. Technical Field

One or more embodiments of the present invention relate to a coaxial cable, and a wiring harness using the same.

2. Description of the Related Art

There has been proposed a coaxial cable in which an insulator, a film and an outer conductor are provided in this order on an outer circumference of an inner conductor, and a sheath is provided on an outer circumference of the outer conductor. In addition, there has been proposed a coaxial cable in which a net-like braid of copper wires (hereinafter referred to as "braid") is provided as the outer conductor, a coaxial cable in which a spiral winding of a copper wire (hereinafter referred to as "lateral winding") is provided likewise, or a coaxial cable having a double layer structure in which copper or aluminum foil is wound and a braid or a lateral winding is further provided on the foil (see Patent Literatures 1 and 2).

Patent Literature 1 is JP-A-2012-119231, and Patent Literature 2 is JP-A-2012-138285.

SUMMARY OF THE INVENTION

Here, in the coaxial cable disclosed in Patent Literatures 1 and 2, cutting is performed at each laminated layer, and work of crimping a terminal and so on is performed after the cutting. However, when the terminal is processed in the coaxial cable disclosed in Patent Literatures 1 and 2, a failure in connection to the terminal or clogging in a cutter for cutting the coaxial cable may occur due to a remaining uncut part of the film (a part of the film remaining in the film itself due to unsatisfactory peeling when the tip of an electric wire is peeled) or a cut-off part of the film (a part of the film peeled off and separated from the film itself).

That is, when there is a remaining uncut part of the film in the coaxial cable disclosed in Patent Literatures 1 and 2, an outer terminal may be connected in a state where the remaining uncut part of the film is located on the outer conductor. In such a case, due to the film located between the outer conductor and the outer terminal, contact resistance increases to cause a failure in connection.

In addition, when an inner terminal or an outer terminal is connected in a state where a cut-off part of the film is located on the inner conductor or the outer conductor, a failure in connection occurs in the same manner as described above.

Further, since the cut-off part of the film is an insulating material, the cut-off part may adhere to the cutter easily due to static electricity. When cut-off parts of the film adhering due to static electricity are accumulated, clogging may occur in the cutter.

One or more embodiments of the present invention have been developed in view of the aforementioned circumstances in the related art. An object of the embodiment is to provide a coaxial cable and a wiring harness using the same, capable of reducing both the possibility that a failure in connection may occur during terminal connection and the possibility that clogging may occur in a cutter.

A coaxial cable according to the one or more embodiments includes: an inner conductor; an insulator that is provided on an outer circumference of the inner conductor; a film that is provided on an outer circumference of the insulator; an outer conductor that is provided on an outer circumference of the film; and a sheath that is provided on an outer circumference of the outer conductor, wherein at least a part of the film is colored in a different color from both colors of the insulator and the outer conductor.

In addition, the film may include a film base and an identification layer, and the identification layer may be colored in a different color from both colors of the insulator and the outer conductor.

In addition, the film may include a film base that is colored in a different color from both colors of the insulator and the outer conductor.

According to the coaxial cable of one or more embodiments of the invention, the film is provided with an identification layer different in a color from both the insulator and the outer conductor, or colored in a different color from both colors of the insulator and the outer conductor. Accordingly, it can be confirmed easily that the film is peeled off during terminal processing, and a remaining uncut part of the film or a cut-off part of the film can be confirmed visually. It is therefore possible to reduce both the possibility that a failure in connection may occur during terminal connection and the possibility that clogging may occur in a cutter.

In addition, in the coaxial cable according to the one or more embodiments, an adhesive layer for bonding the insulator and the film with each other may be provided between the insulator and the film.

According to the coaxial cable, the film is hardly separated from the insulator because the adhesive layer bonding the insulator and the film with each other is provided between the two. As a result, the possibility that a separated part of the film may adhere to the inner conductor or the outer conductor can be reduced. Thus, a failure in connection hardly occurs. In addition, since the film is hardly separated from the insulator, the film hardly adheres to the cutter. Thus, the film hardly causes clogging in the cutter. It is therefore possible to further reduce both the possibility that a failure in connection may occur during terminal connection and the possibility that clogging may occur in the cutter.

In addition, a wiring harness according to the one or more embodiments of the invention includes an assembly of a bundle of a plurality of electric wires including the aforementioned coaxial cable.

According to the wiring harness of the one or more embodiments of the invention, it is possible to reduce the frequency of working for finding out, from a plurality of electric wires during a continuity test on the wiring harness, an electric wire in which a failure in connection occurs because the wiring harness is formed in a state where a failure in connection occurs during terminal connection to the coaxial cable.

According to a coaxial cable of the one or more embodiments of the invention, it is possible to reduce both the possibility that a failure in connection may occur during terminal connection and the possibility that clogging may occur in a cutter. In addition, according to a wiring harness of the one or more embodiments, it is possible to reduce the frequency of working for finding out an electric wire in which a failure in connection occurs.

DETAILED DESCRIPTION OF THE EXEMPLARY EMBODIMENTS

Figure 1:
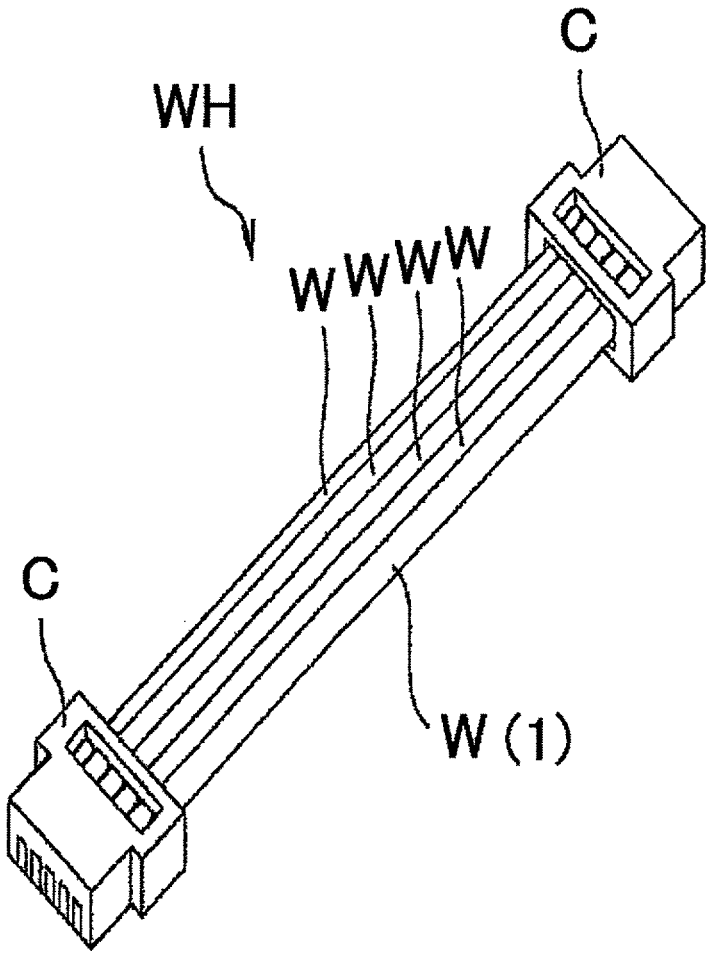
FIG. 1 is a perspective view illustrating an example of a wiring harness according to an embodiment of the invention.

An embodiment of the invention will be described below based on the drawings. FIG. 1 is a perspective view illustrating an example of a wiring harness according to the embodiment of the invention. As illustrated in FIG. 1, a wiring harness WH is an assembly of a bundle of a plurality of electric wires W. At least one of the electric wires W consists of a coaxial cable 1, which will be described below in detail. For example, the wiring harness WH configured thus may have connectors C in both end portions of the electric wires W as illustrated in FIG. 1, or may be wound with a tape (not illustrated) to bundle the electric wires W. In addition, the wiring harness WH may be provided with an exterior component (not illustrated) such as a corrugated tube.

Figure 2A:
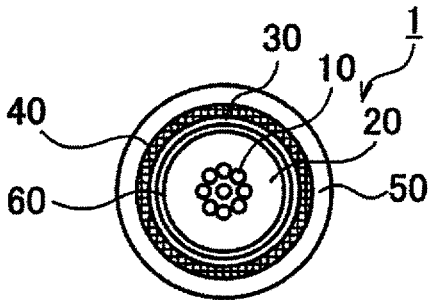
FIGS. 2A and 2B are configuration views illustrating a coaxial cable according to the embodiment of the invention, FIG. 2A being a sectional view, FIG. 2B being a side view.
Figure 2B:
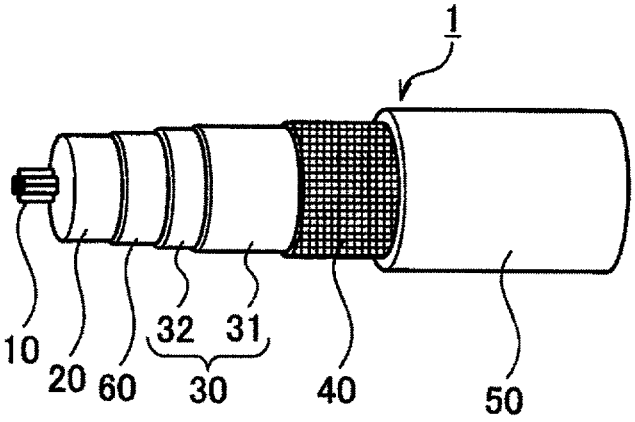

FIGS. 2A and 2B illustrate a configuration of the coaxial cable according to the embodiment of the invention. FIG. 2A is a sectional view and FIG. 2B is a side view. The coaxial cable 1 illustrated in FIG. 2A and FIG. 2B has an inner conductor 10 including a plurality of conductors, an insulator 20 provided on an outer circumference of the inner conductor 10, a film 30 provided on an outer circumference of the insulator 20, an outer conductor 40 provided on an outer circumference of the film 30, and a sheath 50 provided on an outer circumference of the outer conductor 40.

For example, soft copper wires, silver-plated soft copper wires, tin-plated soft copper wires, tin-plated copper alloy wires, etc. may be used for the inner conductor 10. Incidentally, although the inner conductor 10 includes a plurality of wires in the embodiment, the inner conductor 10 may be a single wire.

The insulator 20 is a member applied onto the conductor 10. For example, PE (polyethylene), PP (polypropylene), or foamed PE or PP is used for the insulator 20. The insulator 20 has a dielectric constant not higher than 3.0.

The film 30 is a member that covers a circumference of the insulator 20. The film 30 is provided so that a plasticizer contained in PVC (polyvinyl chloride) or the like used in the sheath 50 or surrounding members can be prevented from permeating the insulator 20 to thereby reduce the attenuation of electromagnetic waves propagated in the coaxial cable 1.

For example, PET (polyethylene terephthalate), polyurethane (SP value is 10), nylon (registered trademark) (SP value is 13.6), or the like, is used for the film 30. That is because a plasticizer used in the sheath 50 or a plasticizer contained in surrounding members may permeate the insulator 20 under a high temperature environment when the film 30 is absent or when the SP value of the film 30 is close to the SP value of the plasticizer. Incidentally, the SP value of a typical plasticizer is 8.9 while the SP value of PE used in the insulator 20 is 8.0 and the SP value of PP used likewise is 7.9.

When the plasticizer permeates the insulator 20, the dielectric constant of the insulator 20 may be increased to reduce the attenuation. More specifically, due to the plasticizer migrating to the insulator 20, the dielectric constant and the dielectric tangent of the insulator 20 increase. The degree of the migration depends on a place of the insulator. As a result, impedance is disturbed greatly. Thus, mismatching occurs to reduce the attenuation greatly. In addition, the degree of reduction in the attenuation increases as the frequency is higher.

Therefore, the coaxial cable 1 according to the embodiment has a sheet-like film 30 between the insulator 20 and the sheath 50. Such a film 30 is made of a material whose SP value has a difference of at least 1.8 from the SP value of 8.9 in a typically used plasticizer (such as DOP (dioctyl phthalate), DINP (diisononyl phthalate), or TOTM (trioctyl trimellitate)).

The outer conductor 40 is a member located in the circumference of the film 30. For example, a braid of soft copper wires, alloy wires, copper-coated steel wires, silver-plated soft copper wires, tin-plated soft copper wires, etc. is used as the outer conductor 40.

The sheath 50 is a member provided on the outer circumferential of the outer conductor 40. For example, the sheath 50 is made of PE, PP, PVC, etc. in the same manner as the insulator 20.

Figure 3:
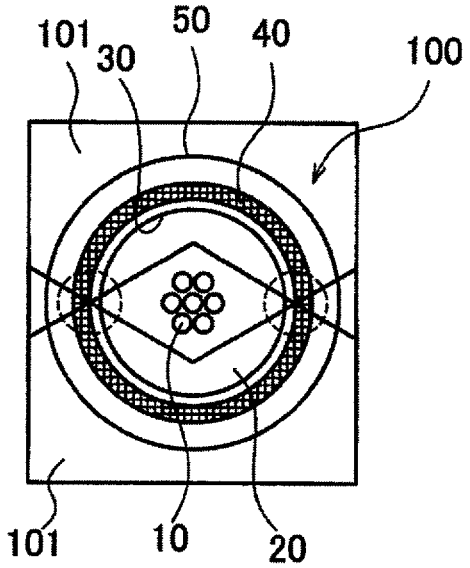
FIG. 3 is a first sectional view illustrating a state in which terminal processing is performed on a coaxial cable according to a comparative example.

FIG. 3 is a first sectional view illustrating a state in which terminal processing is performed on a coaxial cable 100 according to a comparative example. Terminal processing is performed to connect a terminal to the coaxial cable 100. On this occasion, two cutting blades 101 whose tips serve as V blades as illustrated in FIG. 3 are used. The two cutting blades are inserted into the coaxial cable 100 from above and from below respectively, so as to remove the members 20 to 50 on the outer circumferential side of the inner conductor 10.

However, due to the cutting blades 101 serving as the V blades, uncut parts (parts of the film remaining in the film itself due to unsatisfactory peeling when a tip end of the electric wire is peeled) may remain in the film 30 (portions depicted by broken-line circles) at the left and right ends in FIG. 3. Incidentally, this problem about the remaining uncut parts may arise not only when the cutting blades are V blades but also even when they are R blades.

Figure 4:
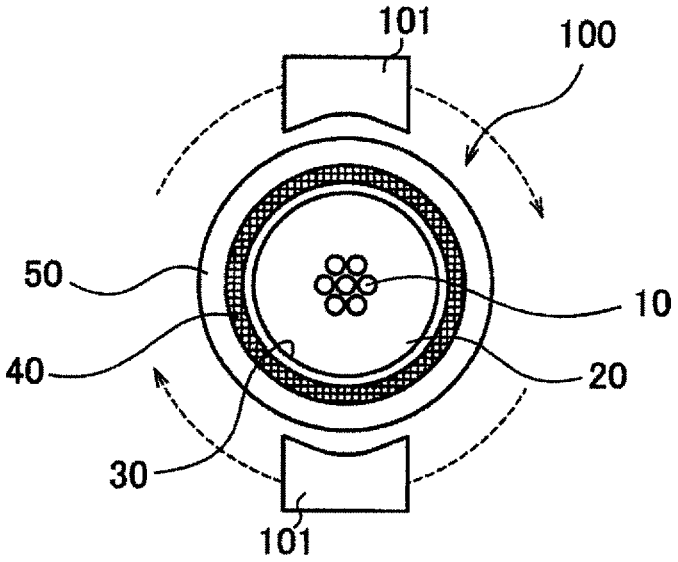
FIG. 4 is a second sectional view illustrating a state in which terminal processing is performed on the coaxial cable according to another comparative example.

FIG. 4 is a second sectional view illustrating a state in which terminal processing is performed on the coaxial cable 100 according to another comparative example. To cut the outer conductor 40, there is another method in which the outer conductor is cut by two cutting blades 101 rotating along the circumference of the coaxial cable 100 as illustrated in FIG. 4. In the case of this method, the tips of the cutting blades 101 are designed to slightly reach the insulator 20 in order to surely cut the outer conductor 40. Even in this case, uncut parts may remain in the film 30.

Then, an outer terminal may be connected in the state where a remaining uncut part of the film 30 is located on the outer conductor 40. In such a case, the film 30 is present between the outer conductor 40 and the outer terminal, with the result that increases in contact resistance may cause a failure in connection.

In addition, the film 30 (a cut-off part of the film peeled off from the film itself) cut thus is typically in a transparent color or the like. It is therefore difficult to visually confirm the film 30. Thus, a cut-off part of the film 30 may be located on the inner conductor 10 or on the outer conductor 40. When an inner terminal or an outer terminal is connected in this state, a failure in connection may occur in the same manner as described above.

Further, each cut-off part of the film 30 is a light insulator, which can adhere to a cutter easily due to static electricity. When cut-off parts of the film 30 adhering due to static electricity are accumulated, clogging may occur in the cutter.

Therefore, in the coaxial cable 1 according to the embodiment, as illustrated in FIG. 2B, the film 30 has a double layer structure of a film base 31 and an identification layer 32. The film base 31 is, for example, in a transparent color, and the identification layer 32 has a different color from both colors of the insulator 20 and the outer conductor 40, and the identification layer 32 is applied to the inner surface of the film base 31. It is therefore easy to confirm that the film 30 is peeled together with the insulator 20 during terminal processing. In addition, it is also possible to visually confirm a remaining uncut part of the film 30 or a cut-off part of the film 30. Thus, it is possible to reduce both the possibility that a failure in connection may occur during terminal connection and the possibility that clogging may occur in the cutter. Incidentally, specifically the color of the identification layer 32 may be set as one of blue, orange, pink, red and green, but blue is more preferable.

Further, in the coaxial cable 1 according to the embodiment, an adhesive layer 60 for boding the insulator 20 and the film 30 with each other is intervened between the insulator 20 and the film 30. Due to the adhesive layer 60 thus intervened, the film 30 is hardly separated from the insulator 20. Thus, the film 30 hardly adheres to the inner conductor 10 or the outer conductor 40, and a failure in connection hardly occurs. In addition, since the film 30 is hardly separated from the insulator 20, the film 30 hardly adheres to the cutter, and the film 30 hardly causes clogging in the cutter.

Here, it is efficient that the adhesive layer 60 bonds the insulator 20 and the film 30 using remaining heat generated when the sheath 50 of the coaxial cable 1 is extruded. To this end, hot melt adhesive such as polyester based resin, ethylene-vinyl acetate based resin, etc., which can be welded by the remaining heat of the extrusion, may be used as the adhesive layer 60.

Next, an example of a method for manufacturing the coaxial cable 1 according to the embodiment will be described. In order to manufacture the coaxial cable 1 according to the embodiment, first, the outer circumference of the inner conductor 10 is coated with the insulator 20 by an extruder. Here, the inner conductor 10 is, for example, a stranded wire of seven soft copper strands each having a diameter of 0.18 mm and totally having an outer diameter of 0.54 mm. Further, crosslinked foamed PE is used for the insulator 20. The outer diameter covered with the insulator 20 reaches 1.6 mm.

Next, the adhesive layer 60 side of the film 30 (that is, adhesive film) applied with the identification layer 32 and having the adhesive layer 60 is pasted onto the insulator 20. At that time, the outer diameter reaches, for example, 1.7 mm.

After that, the outer conductor 40 consisting of a tin-plated soft copper braid is attached onto the film 30. The outer conductor 40 has a wire configuration of 0.10/5/16 in mm/wires/strands. In addition, at that time, the outer diameter reaches about 2.2 mm.

Next, the sheath 50 made of heat-resistant PVC is applied onto the outer conductor 40 by an extruder. On this occasion, the adhesive layer 60 melts by remaining heat generated by the extruder so as to bring the insulator 20 and the film 30 into tight contact. Incidentally, at that time, the outer diameter reaches 3.0 mm.

In the coaxial cable 1 according to the embodiment manufactured thus, the film 30 is provided with the identification layer 32 different in color from both the insulator 20 and the outer conductor 40, or colored in the different color from both colors of the insulator 20 and the outer conductor 40. It is therefore easy to confirm that the film 30 is peeled during terminal processing. In addition, it is also possible to visually confirm a remaining uncut part of the film 30 or a cut-off part of the film 30. Thus, it is possible to reduce both the possibility that a failure in connection may occur during terminal connection and the possibility that clogging may occur in the cutter.

In addition, due to the adhesive layer 60 provided between the insulator 20 and the film 30 so as to bond the both with each other, the film 30 is hardly separated from the insulator. Thus, the film 30 hardly adheres to the inner conductor 10 or the outer conductor 40, and a failure in connection hardly occurs. In addition, since the film 30 is hardly separated from the insulator 20, the film 30 hardly adheres to the cutter and hardly causes clogging in the cutter. It is therefore possible to further reduce both the possibility that a failure in connection may occur during terminal connection and the possibility that clogging may occur in the cutter.

Although the invention has been described above based on the embodiment, the invention is not limited to the embodiment, but it may be changed without departing from the gist of the invention.

For example, the coaxial cable 1 according to the embodiment is not limited to what has been described with reference to FIG. 2, but various changes may be made thereon. For example, the inner conductor 10 does not have to consist of a stranded wire of soft copper strands, or the sheath 50 does not have to consist of heat-resistant PVC. In addition, various changes may be similarly made on the insulator 20 or the outer conductor 40.

Further, although the hot melt adhesive is used for the adhesive layer 60 in the coaxial cable 1 according to the embodiment so as to be welded when the sheath 50 is extruded, the invention is not limited thereto. The insulator 20 and the film 30 may be bonded with each other simply by a bonding agent such as paste.

Further, although the identification layer 32 is formed by application to the film 30 in the embodiment, the invention is not limited thereto. The identification layer 32 may be formed into a sheet-like shape and pasted to the film 30. Further, the identification layer 32 may be provided outside the film 30.

In addition, the identification layer 32 does not have to be provided in the embodiment. A dye may be kneaded into the film base 31 so that the film 30 itself can be colored in a different color from both colors of the insulator 20 and the outer conductor 40. In this manner, it is possible to obtain a similar effect to that in the case where the identification layer 32 is provided.

Here, the characteristics of the aforementioned embodiment of the coaxial cable according to the invention and the wiring harness using the same will be summarized briefly in the following items [1] to [5].

[1] A coaxial cable (1) including an inner conductor (10), an insulator (20) that is provided on an outer circumference of the inner conductor (10), a film (30) that is provided on an outer circumference of the insulator (20), an outer conductor (40) that is provided on an outer circumference of the film (30), and a sheath (50) that is provided on an outer circumference of the outer conductor (40), wherein at least a part of the film (30) is colored in a different color from both colors of the insulator (20) and the outer conductor (40).

[2] The coaxial cable (1) according to the aforementioned item [1], wherein:

the film (30) includes a film base (31) and an identification layer (32); and the identification layer (32) is colored in a different color from both colors of the insulator (20) and the outer conductor (40).

[3] The coaxial cable (1) according to the aforementioned item [1], wherein the film (30) includes a film base (31) that is colored in a different color from both colors of the insulator (20) and the outer conductor (40).

[4] The coaxial cable (1) according to any one of the aforementioned paragraphs [1] through [3], further including an adhesive layer (60) that is provided between the insulator (20) and the film (30), the adhesive layer (60) bonding the insulator (20) and the film (30) with each other.

[5] A wiring harness (WH) including an assembly of a bundle of a plurality of electric wires (W) including the coaxial cable according to any one of the aforementioned items [1] through [3].

Although the invention has been described in detail and with reference to its specific embodiment, it is obvious for those skilled in the art that various changes or modifications can be made on the invention without departing from the spirit and scope thereof.

According to the invention, there is an advantage that it is possible to reduce both the possibility that a failure in connection may occur during terminal connection and the possibility that clogging may occur in a cutter. The invention attaining the advantage is useful for a coaxial cable.

What is claimed is:

1. A coaxial cable comprising:

an inner conductor;

an insulator that is provided on an outer circumference of the inner conductor;

a film that abuts an outer circumference of the insulator;

an outer conductor that abuts on an outer circumference of the film; and a sheath that is provided on an outer circumference of the outer conductor, wherein at least a part of the film is colored, over an entire circumferential direction of the insulator, in a different color from both colors of the insulator and the outer conductor.

2. The coaxial cable according to claim 1, wherein the film includes a film base and an identification layer; and the identification layer is colored in a different color from both colors of the insulator and the outer conductor.

3. The coaxial cable according to claim 1, wherein the film includes a film base that is colored in a different color from both colors of the insulator and the outer conductor.

4. The coaxial cable according to claim 1, further comprising:

an adhesive bonding the insulator and the film with each other.

5. A wiring harness comprising an assembly of a bundle of a plurality of electric wires including the coaxial cable according to claim 1.

6. The coaxial cable according to claim 1, wherein the film covers the insulator in the entire circumferential direction of the insulator.

7. The coaxial cable according to claim 1, wherein the film is configured to prevent plasticizer from permeating the insulator.

8. The coaxial cable according to claim 1, wherein the sheath abuts the outer circumference of the outer conductor, and the film includes at least one layer, and each layer of the film is a non-metallic layer.

* * * * *